United States Patent [19]

Lantz

[11] 3,935,829

[45] Feb. 3, 1976

[54] ANCHORING SYSTEM FOR A FLOATING OFFSHORE DRILLING VESSEL

[75] Inventor: Claude C. Lantz, Noisy-le-Roi, France

[73] Assignee: Forex Neptune S.A., Paris, France

[22] Filed: Nov. 19, 1973

[21] Appl. No.: 417,180

[30] Foreign Application Priority Data

Nov. 24, 1972 France ..... .41780

[52] U.S. Cl. ..... 114/206 R

[51] Int. Cl.[2] ..... B63B 21/50

[58] Field of Search ..... 114/206 R, 230; 9/8 R, 9/8 P

[56] References Cited

UNITED STATES PATENTS

| | | | |
|---|---|---|---|
| 2,568,006 | 9/1951 | Illsche | 114/206 R |
| 3,094,755 | 6/1963 | Casanave | 114/230 |
| 3,295,489 | 1/1967 | Bossa | 114/230 |
| 3,385,252 | 5/1968 | Sekkelsten | 114/230 |
| 3,712,260 | 1/1973 | Mott et al. | 114/230 |
| 3,799,097 | 3/1974 | Robertson | 114/206 R |

FOREIGN PATENTS OR APPLICATIONS

| | | | |
|---|---|---|---|
| 598,037 | 2/1948 | United Kingdom | 114/230 |

*Primary Examiner*—Trygve M. Blix
*Assistant Examiner*—Stuart M. Goldstein
*Attorney, Agent, or Firm*—David L. Moseley; William R. Sherman; Stewart F. Moore

[57] ABSTRACT

An anchoring system for a floating drilling vessel or the like comprises a wire rope having one end attached to an anchor and the other end secured to the drilling vessel. The secured end has attached thereto a floating tag line with a length greater than the location water depth, making it possible to easily recover a wire rope that is cast-off in the event the vessel is required to quickly leave its location, for example, in an emergency.

7 Claims, 5 Drawing Figures

FIG. 1
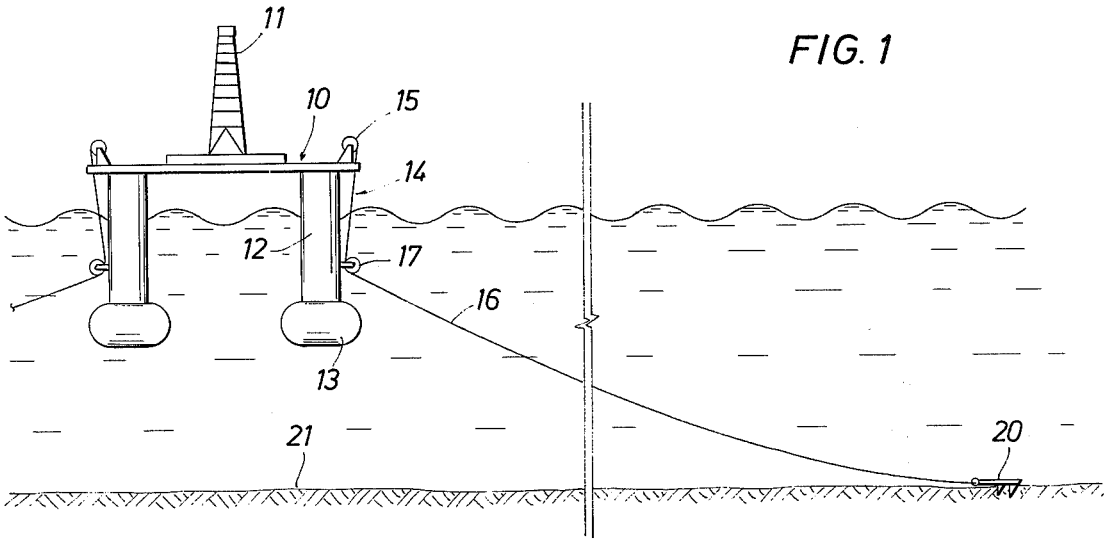
FIG. 2
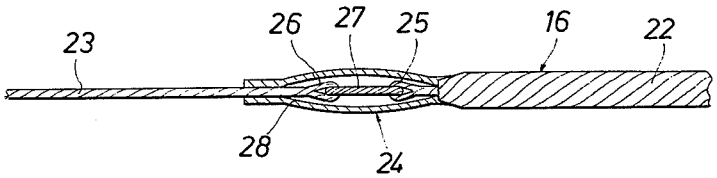
FIG. 3
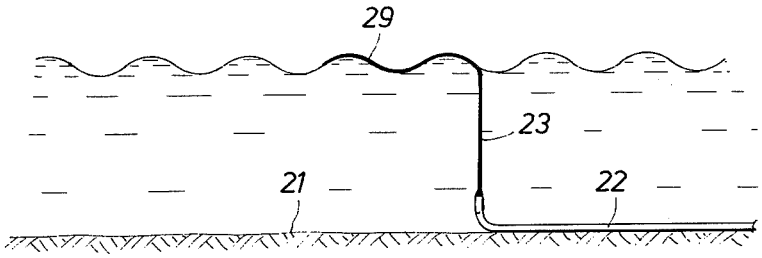
FIG. 4
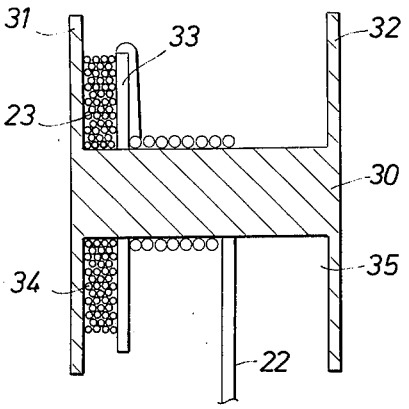
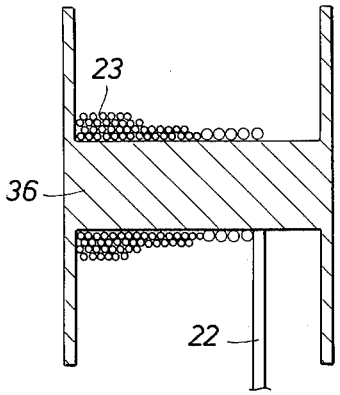
FIG. 5

ANCHORING SYSTEM FOR A FLOATING OFFSHORE DRILLING VESSEL

This invention relates to an anchoring or mooring system used to position a floating drilling vessel.

Floating drilling vessels (ships or semisubmersible platforms) generally are secured on the drilled site by a plurality of anchor lines. Each of the lines which may be a steel wire rope, for example, has its remote end attached to an anchor and its near end would around a winch that is mounted on the vessel. The winch makes it possible to take up and to pay out the line which runs over a guide or idler pulley mounted on the drilling unit. Each of the anchor lines must have adequate strength in view of design criteria for holding such a massive vessel in the face of wind, wave and current forces and in substantial water depths, and necessarily is quite large expensive. To afford an idea of the orders of magnitude involved, on a semisubmersible platform such as those presently used, each mooring line may have a diameter of 7 cm and a length of 1,700 m, and cost, for example, about $20,000.

The anchors are generally dropped by a service vessel when the platform has reached the drilling location, and are weighed in the same manner when drilling operations are completed. Such anchor dropping and weighing operations are relatively long (12 hours or so in normal weather) and difficult if not impossible to achieve in bad weather. If, during drilling, the platform must quickly leave its location, for example if there is a danger of collision with an iceberg, which may in fact occur in operations off Nordic shores, or in case of violent blowout, there may be no time to weigh anchor by normal methods. It then becomes necessary to cast off the mooring lines from the platform. In order to be able subsequently to recover the lines, prior art systems have utilized a buoy that is attached by a cable or chain as near the end of the line as possible. When it is safe to return to the drilling location, the buoy serves as a marker to enable the mooring lines to be recovered.

The foregoing procedure has had certain drawbacks however. In the usual semisubmersible platform, the guide pulley is immersed at a point relatively far from the winch. Thus the buoys, which are secured when the platform is placed on location, are connected at a point below the guide pulley which is relatively far from the end of the line. After casting off, that part of the anchor line located between the buoy connection point and the free end can become tangled, thereby preventing retrieval. In fact, a steel wire rope has a great tendency to form loops when its end is free, especially if it is exposed to severe service conditions, as is the case with anchoring lines which sometimes bear loads near their yield strength. Moreover, once cast off, the lines can become tangled with each other.

The principle object of this invention to provide a new and improved anchoring system that makes it possible to avoid such difficulties and to save precious time in setting up the platform again after emergency cast-off.

This and other objects are attained in accordance with the concepts of the present invention through the provision of an anchoring system wherein the end of the mooring line opposite the anchor is attached to a floating tag line having a specific gravity lower than unity and a length greater than the depth of water at which the drilling operations are to take place. In this manner, when a line is cast off, the entire anchor line comes to rest on the ocean floor while the free end of the tag line floats on the surface. When the anchor line is to be retrieved, the floating tag line is picked up and the line is pulled by its free end, thereby minimizing the possible formation of loops. Preferably, the free end of the tag line is provided with means of identification, for example a color and/or an identification number.

When the drilling unit is in the anchored position, the entire floating tag line and at least part of the wire rope are would on the winch. The tag line and rope are connected by a coupling that presents a smooth exterior. In a preferred embodiment, the drum of the winch is divided into two compartments by a partition substantially perpendicular to the drum axis. One of the compartments makes it possible to wind substantially the entire tag line while the other compartment is large enough for winding the anchor line.

Further features and advantages of the invention will appear from the following description taken in connection with the appended drawings in which:

FIG. 1 is a schematic view of a semisubmersible platform in the anchoring position;

FIG. 2 is a partial section of an anchoring line according to the invention;

FIG. 3 is a view of the anchoring line cast-off;

FIG. 4 is a first system for winding the anchoring line according to the invention; and FIG. 5 is a second system for winding this anchoring line.

Referring to FIG. 1, a semisubmersible drilling platform 10 on which is mounted a derrick 11, comprises columns 12 at the lower end of which are provided pontoons 13 capable of being immersed to the desired depth. The platform is secured by means of anchoring devices 14 arranged all around the platform. Each anchoring device comprises a winch 15 mounted on the platform and on which is wound a mooring line 16. The mooring line 16, which runs over a guide pulley 17, carries at its end an anchor 20 gripping the sea bottom 21.

Referring to FIG. 2, the mooring line 16 consists of a wire rope 22 one end of which is attached to the anchor 20 and the other end of which is extended by a floating tag line 23 made of a synthetic material having a low specific gravity, for example polypropylene. The connection 24 between the wire rope 22 and the tag line 23 can be achieved as shown in FIG. 2. A first loop 25 is made with the core of the wire rope 22. A second loop 26 is made with the end of the tag line 23. The two loops are then joined by means of a shackle 27, and the assembly is covered by a flexible sheath 28 presenting a smooth exterior to facilitate the passage of the line through the guide pulley 17. The free end of the floating tag line can be colored and assigned an identification number.

When the semisubmersible platform is in the anchored position, the entire tag line 23 and part of the wire rope 22 are wound on the winch 15. If, in case of emergency, the platform 10 must leave the drilling location, all the winches 15 are successively unwound to cast off the mooring lines 16. Almost the entire length of the wire rope 22 then lies on the ocean floor (FIG. 3) while the tag line 23, one end (29) of which floats, remains suspended almost vertically between the floor and the surface, pulled downward by the wire rope 22. To retrieve the mooring line 16, one need only pick up the floating end 29 and wind it on the drum of the winch 15. The colored part and the assigned number facilitate the location and identification of this floating end 29. By turning the winch, the wire rope 22 is pulled by its end and raised, thereby minimizing the possibility of damaging the rope.

It will be noted that the tag line 23 and the connection 24 between it and the rope support only relatively small forces due simply to the weight of the wire rope 22, the forces necessary for securing the platform on the drilling site being applied only to the wire rope 22. The connection 24 can thus be designed in a simple manner, as shown for example in FIG. 2. Moreover, the breaking strength of the tag line, and consequently its diameter, can be relatively small. By way of example, in a particular case where the rope necessary for supporting the platform anchoring forces is a steel wire rope about 7 cm in diameter and about 1,500 m long with a breaking strength of 340 metric tons and a weight of 20 metric tons per km, a synthetic tag line of 44 mm diameter has been chosen with a breaking strength of 23 metric tons.

When the mooring line is wound on the winch 15, the tag line must not be crushed under the wire rope. Preference is thus given to a drum 30 (FIG. 4) having two sides 31 and 32 and an intermediate partition 33 which divides the drum into two compartments 34 and 35 of different size. The tag line 23 is wound in the small compartment 34 and the wire rope 22 in the large compartment 35. It is thus possible to fit the two elements of the anchoring line on the drum before beginning the operations.

It is also possible to use a conventional drum 36 (FIG. 5) involving a slightly more complex procedure. When the anchors have been dropped, the wire rope 22 is completely unwound from the winch and its end is secured to the platform. Then the floating tag line is wound on one side of the drum, leaving an empty part. The tag line is then connected to the wire rope and a few turns of the rope are wound on the free part of the drum.

The anchoring system of the present invention can be used wherever a ship anchored normally at a given location must be able to leave its position quickly. It will of course be understood that the invention has many possible variants, in particular with regard to the diameter, the material and the breaking load of the floating tag line, which are adapted to the drilling unit. Such changes and modifications would not depart from the inventive concepts involved herein, and thus it is the aim of the appened claims to cover all such changes or modifications falling within the true spirit and scope of the present invention.

I claim:

1. An anchoring system for use in mooring a floating vessel of the type having an anchor line storage winch located above the surface of the water, comprising: an anchor line having a portion of its length including one end thereof wound on said storage winch, said anchor line passing from said winch toward the water bottom where the other end thereof is adapted to be secured to an anchor; a tag line wound on said winch ahead of said portion of said anchor line and having an inner end and an outer end; and coupling means for connecting said outer end of said tag line directly to said one end of said anchor line; said tag line being constructed of a material having a specific gravity less than one so as to tend to float in a body of water, and having a length greater than the depth of water in which the vessel is to be anchored so as to reach from the water bottom to the surface, so that when said portion of said anchor line and the said entire length of said tag line are wound off of said winch said anchor line can sink to the water bottom with said tag line extending from said one end to the water surface; said winch including a drum divided into two compartments along its axis of rotation by a partition substantially perpendicular to the said axis, one of said compartments receiving only said tag line and the other of said compartments receiving only said portion of said anchor line.

2. The system of claim 1 wherein the said tag line is made of synthetic material.

3. The system of claim 1 further including a sheath covering said coupling means to present a substantially smooth exterior surface.

4. The system of claim 1 wherein the said inner end of the said tag line is provided with means for identifying the anchor line to which it is connected.

5. The system of claim 4 wherein said means of identification is a color.

6. The system of claim 4 wherein said means of identification is a number.

7. The system of claim 1 wherein said one compartment is dimensioned such that it is substantially filled by said entire length of the said tag line.

* * * * *